United States Patent [19]

Bush et al.

[11] 4,113,089

[45] Sep. 12, 1978

[54] SUPPORT FIXTURES FOR PREASSEMBLED UNIT OR CARTRIDGE FOR MULTI-STAGE BARREL TYPE CENTRIFUGAL PUMPS

[75] Inventors: Austin R. Bush, Madison; Frank L. Ferrarese, Nutley, both of N.J.

[73] Assignee: Worthington Pump, Inc., Mountainside, N.J.

[21] Appl. No.: 773,778

[22] Filed: Mar. 2, 1977

Related U.S. Application Data

[62] Division of Ser. No. 716,664, Aug. 23, 1976.

[51] Int. Cl.[2] ..... B65D 85/68

[52] U.S. Cl. ..... 206/319; 206/446; 206/452; 248/13

[58] Field of Search ..... 415/219 R; 417/238, 417/360; 206/318, 319, 413, 446, 452; 248/13

[56] References Cited

U.S. PATENT DOCUMENTS

| | | | |
|---|---|---|---|
| 1,772,731 | 8/1930 | Romine | 206/452 |
| 2,300,259 | 10/1942 | Kueppers | 206/319 |
| 2,546,923 | 3/1951 | Dunneback | 206/319 |
| 2,732,936 | 1/1956 | Lankford | 206/446 |
| 3,781,139 | 12/1973 | Lohse | 206/319 |
| 3,835,986 | 9/1974 | Beau | 206/446 |
| 3,927,763 | 12/1975 | Strub et al. | 206/319 |
| 3,976,393 | 8/1976 | Larson | 415/219 R |

FOREIGN PATENT DOCUMENTS

| | | | |
|---|---|---|---|
| 709,561 | 5/1954 | United Kingdom | 206/319 |

*Primary Examiner*—William Price
*Assistant Examiner*—Bruce H. Bernstein
*Attorney, Agent, or Firm*—Daniel H. Bobis

[57] ABSTRACT

A preassembled unit or inner cartridge for a multi-stage barrel type centrifugal pump including, bearings, seals, balancing device, impellers and diffusers is aligned, balanced and pressed together into assembled position by a resilient means for stressing the parts against a pair of spaced handling clamps at opposite ends of the preassembled unit which permits the shaft to act as an elongated tie bolt to hold the preassembled unit or cartridge so that it can be installed or removed easily from the fixed outer casing of the multi-stage barrel type centrifugal pump.

The unit or cartridge is preassembled and aligned in a special supporting frame which duplicates the engagement shoulder and end face on the pump casing so that all adjustments can be made easily and precisely at a point away from the pump.

A movable fixture can also be provided and positioned so as to permit the aligned, adjusted and preassembled unit or cartridge to be installed, removed or reinstalled in the fixed outer casing for the multi-stage barrel type centrifugal pump.

2 Claims, 18 Drawing Figures

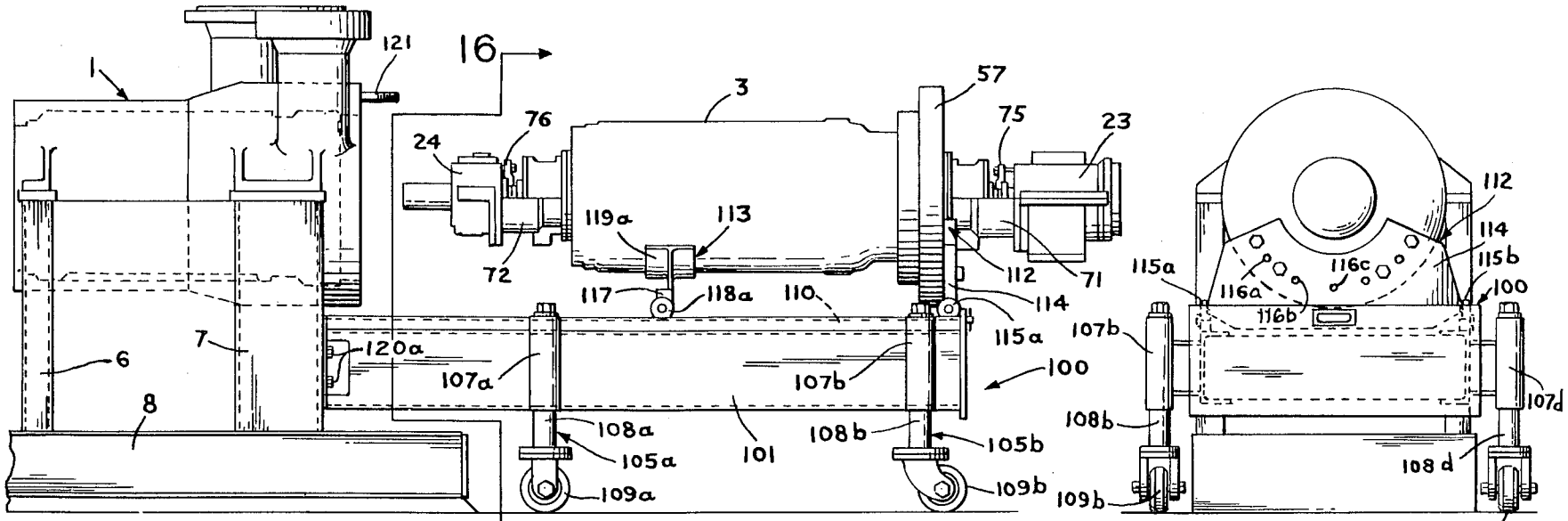
FIG. 15
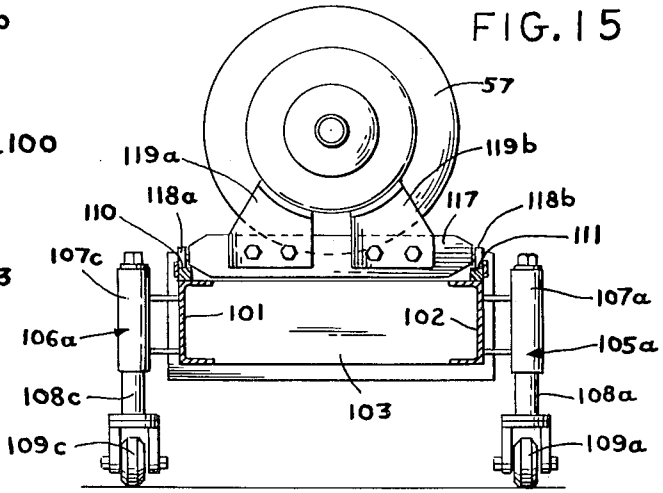
FIG. 16
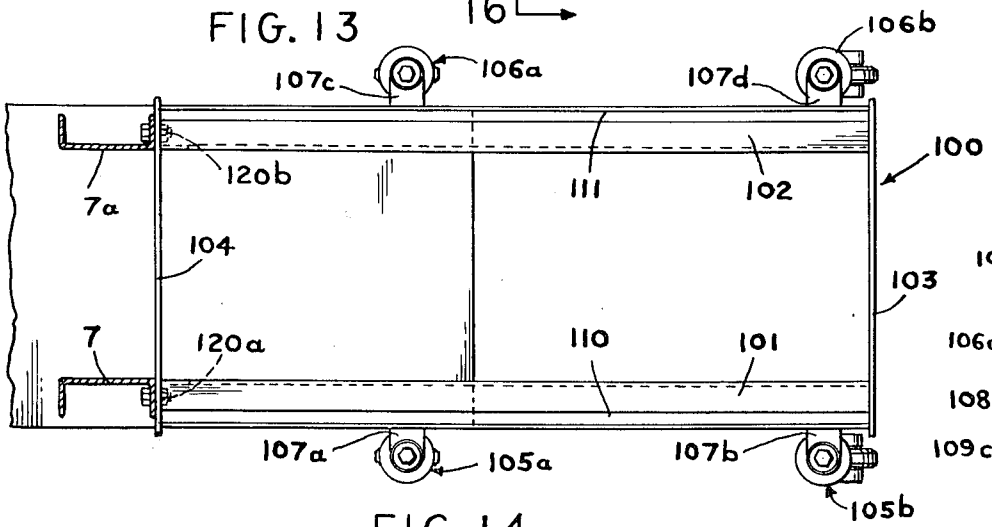
FIG. 13
FIG. 14

SUPPORT FIXTURES FOR PREASSEMBLED UNIT OR CARTRIDGE FOR MULTI-STAGE BARREL TYPE CENTRIFUGAL PUMPS

This is a division, of application Ser. No. 716,664 filed 8/23/76.

BACKGROUND OF THE INVENTION

This invention relates generally to a multi-stage barrel type centrifugal pump and more particularly to a preassembled unit or cartridge forming an inner assembly for a multi-stage barrel type centrifugal pump having all working pump parts including, bearings, seals, and thrust balancing device, as well as the impeller and diffuser adaptable for insertion in and removal from the fixed outer casing for the pump.

It is well known that in the replacement of the working parts of prior art multi-stage barrel type pumps that it is first necessary to dismantle and remove the bearing seals, balancing device and inner elements, then replace the required working parts, and then reassemble all the elements and associated parts for the pump.

The replacement and reassembly process requires adjustments in axial and radial rotor position to obtain satisfactory running clearances between the moving and stationary parts of the pump, and the overall process of element replacement requires many hours of labor in the field where labor rates tend to be high and during which time the pump is not available for service. One effort to meet and overcome this problem is shown in U.S. Pat. No. 3,927,763.

The present invention overcomes this problem of barrel type centrifugal pumps by providing a preassembled, adjusted and aligned unit or cartridge having all the working parts of the pump i.e., bearings, seals, and balancing device as well as the impellers and diffusers which can be installed or removed easily from the barrel or outer casing for the pump, and renewal of the pump merely requires the removal and installation of a preassembled replacement unit or cartridge.

The unit or cartridge concept is made possible by means of a special rig or frame which duplicates the pump casing in supporting the unit or cartridge. This permits all adjustments to be made and checking of the rotor for free rotation to be done before installation in the pump.

The fixture can also be moved to the assembly point near the pump and in this context acts as a carrier for transporting the cartridge.

Thus, precise assembly and adjustment can be made at the machine or service shop where more highly trained personnel are located and where labor charges are less costly.

SUMMARY OF THE INVENTION

Thus the present invention covers a preassembled and prealigned cartridge for installation in and removal from the outer casing of a multi-stage barrel type centrifugal pump, including, all working pump parts mounted on a centrally disposed driven shaft, at least one deformable resilient means for stressing said working pump parts in assembled position, and spaced handling clamps mounted on the driven shaft at opposite ends of said working pump parts operatively associated with said resilient means to permit the shaft to act as a tie-bolt for holding said working pump parts thereon during handling and movement of said preassembled and prealigned cartridge.

Accordingly, it is an object of the present invention to provide a preassembled and prealigned unit or cartridge which can be easily installed and removed from the outer fixed casing of a multi-stage barrel type centrifugal pump.

It is another object of the present invention to provide a preassembled and prealigned unit or cartridge which is so stressed that the driven shaft therethrough acts as a tie-bolt to hold all elements in assembled position.

It is a further object of the present invention to provide a fixture or rig in which the driven shaft and all working pump parts can be so preassembled and prealigned that a unit or cartridge is formed which can be inserted and removed from the fixed outer casing for a multi-stage barrel type centrifugal pump.

These and other objects and advantages will become more apparent from the following detailed description taken in conjunction with the accompanying drawings in which:

FIG. 13 is a side elevation of another form of supporting fixture for the preassembled unit or cartridge in accordance with the present invention in assembled position for moving a preassembled unit or cartridge into position into the fixed outer casing of a multi-stage centrifugal pump.

FIG. 14 is a top view of the form of the invention shown in FIG. 13 with the preassembled unit and movable supports removed.

FIG. 15 is an end view of the supporting fixture shown in FIG. 13.

FIG. 16 is a cross-section taken on line 16—16 of FIG. 13.

Figure 1:
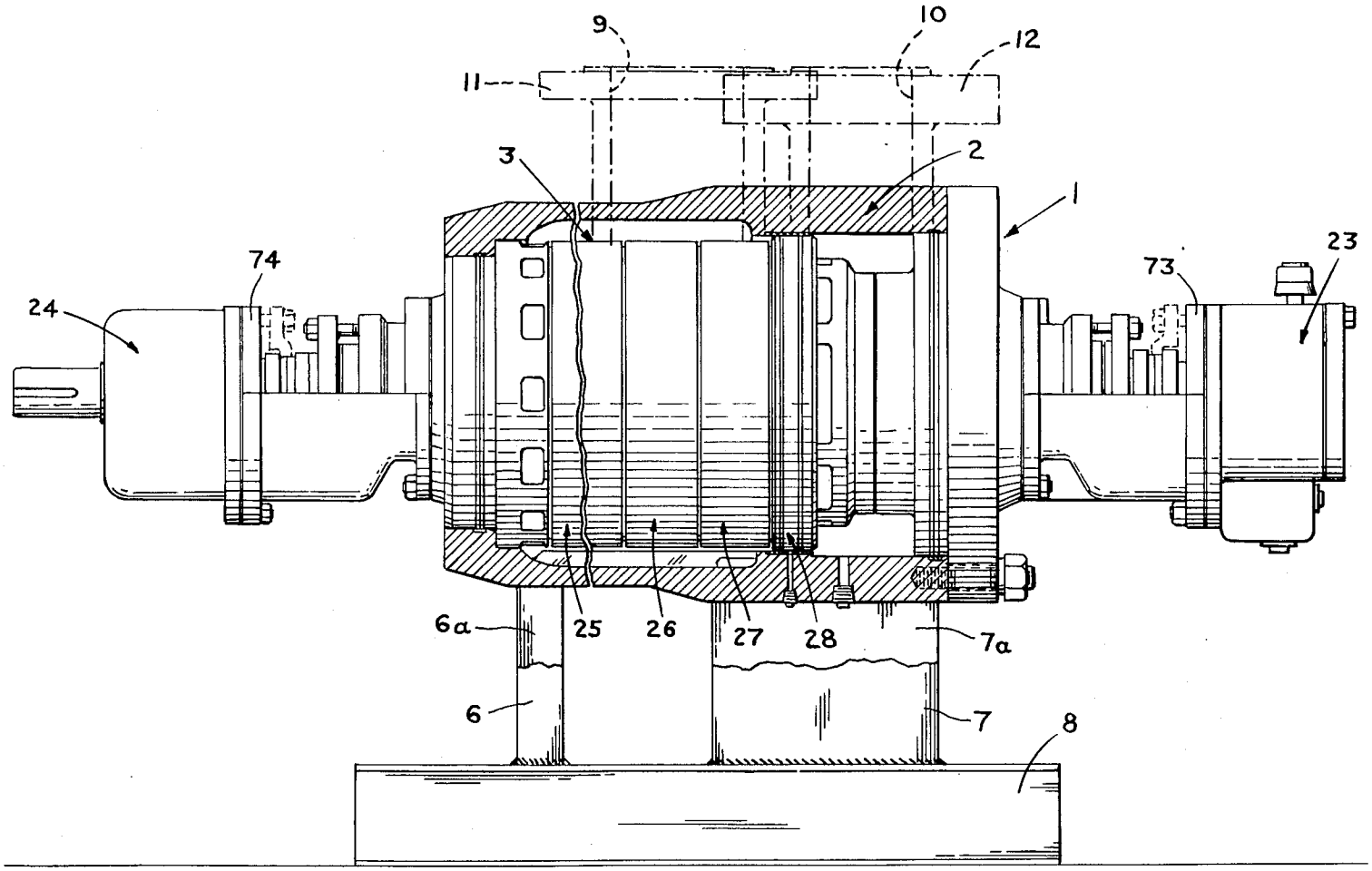
FIG. 1 is a side view of a multi-stage centrifugal pump showing the outer casing in section and the preassembled inner unit or cartridge and associated parts in side elevation.

Referring to the drawings FIG. 1 shows one form of multistage barrel type centrifugal pump generally designated 1 having a fixedly mounted cylindrical outer casing 2 and a preassembled unit or cartridge 3 in accordance with the present invention.

Figures 2, 3, 4, 5:
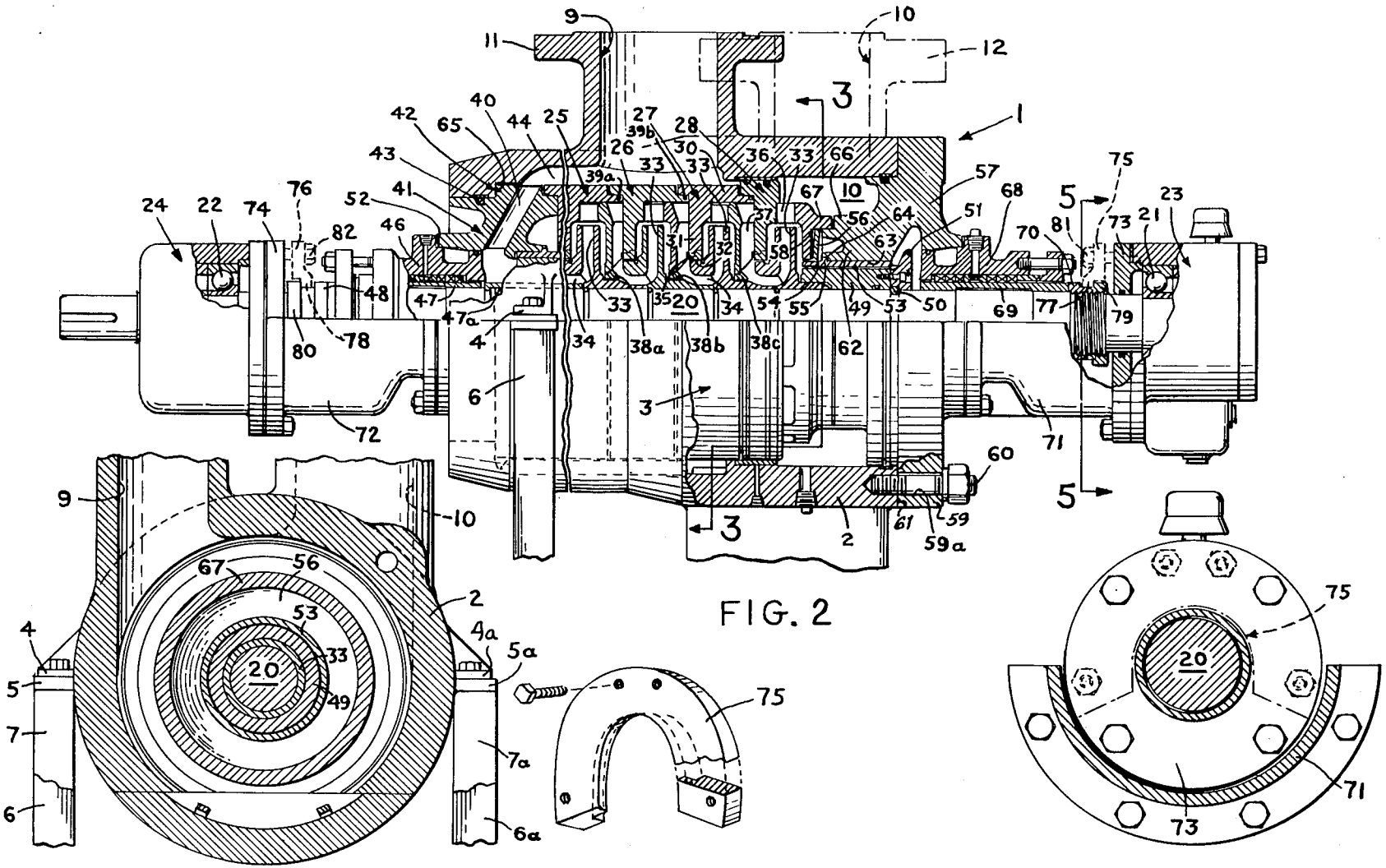
FIG. 2 is a side view of the multi-stage centrifugal pump having the outer casing and the preassembled inner unit or cartridge in partial vertical section and partial side elevation and showing the handling clamps dotted in assembled position.
FIG. 3 is a cross-section taken on line 3—3 of FIG. 2.
FIG. 4 is a perspective view of one handling clamp.
FIG. 5 is a cross-section taken at line 5—5 of FIG. 2.
Figure 8:
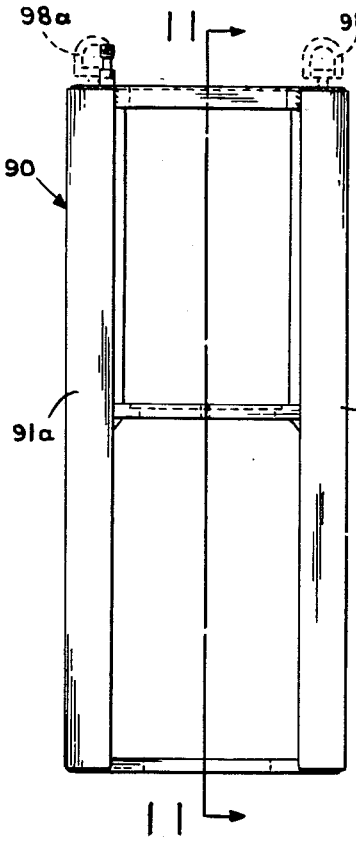
FIG. 8 is a side view of one form of supporting fixture for the preassembled unit or cartridge.

The outer casing 2 is connected by spaced mounting pads 4 and 4*a* and 5 and 5*a* respectively on opposite sides thereof to corresponding spaced support members 6 and 6*a* and 7 and 7*a* which are on a suitable base member 8, as is shown in FIGS. 1, 2 and 3.

The outer casing 2 is further provided with a side inlet 9 and a side outlet 10 which are connected by flanges 11 and 12 respectively thereon to suitable piping, not shown, for passing fluid to be pumped to the centrifugal pump 1 and for delivering the pump fluid from the centrifugal pump 1 to the application or use to which the fluid will be put.

In accordance with the present invention centrifugal pump 1 has mounted therein the preassembled unit or cartridge 3 which as hereinafter more fully described will be assembled in a special fixture or rig away from the pump. The fixture or rig will be brought to the pump and the unit or cartridge will then be lifted from the fixture or rig in a horizontal position and moved and fitted as by sliding the same into the outer cylindrical casing at the point where it is fixed for the system or application in which it is used.

One form of special fixture or rig for this purpose is shown at FIGS. 8 to 12 of the drawings and another form of such special fixture or rig is shown at FIGS. 13 to 18.

In the special fixture or rig all of the parts and elements of the pump are assembled, aligned, adjusted and tested for proper operation before the preassembled and prealigned inner unit or cartridge is placed in assembled position in the fixed outer cylindrical casing 2 of the centrifugal pump 1.

PREASSEMBLED UNIT OR CARTRIDGE

The preassembled unit or cartridge 3 is shown to include an elongated driven shaft 20 which extends centrally from end to end of the preassembled unit or cartridge 3 and is rotatably mounted in a pair of spaced bearings as at 21 and 22 which are disposed in bearing housings 23 and 24 respectively disposed adjacent the outermost portion of the respective ends of the shaft 20 as is shown in FIGS. 1 and 2 of the drawings.

Fixedly mounted about the medial section of the shaft 20 are a plurality of pumping stages as at 25, 26, 27, and 28. All of the pumping stages include the same elements and are more fully described hereinafter.

Thus by reference to pumping stage 27 it is shown that each pumping stage includes, a pumping stage casing 30 which defines a pumping chamber 31 having a central opening as at 32. Disposed in the pumping chamber 31 is an impeller 33 which is fixedly connected and rotatable with the driven shaft 20. The impeller 33 is disposed so that the suction eye 34 of the impeller lies in the central opening to coact with a wearing ring as at 35 therein. Fluid being pumped will be discharged from the periphery of the impeller into the diffuser 36 and will pass by discharge passage 37 from the given pumping stage. This construction is well known as will be understood by those skilled in the art.

Labyrinth seals as at 38*a*, 38*b* and 38*c* are provided at the discharge passage end of each given pumping stage to limit leakage of the fluid being pumped, an obvious expedient also known to those skilled in the art.

The pumping stages 25, 26, 27, and 28 are in abutting relation with each other with conventional "O" ring seals as at 39*a* and 39*b* therebetween.

The first pumping stage 25 has the suction eye 34 of its impeller 33 in communication with a suction inlet passage 40 formed in a suction end casing 41 which is provided with an annular shoulder 42 and suitable seal means as at 43. The suction inlet passage 40 communicates through an annular chamber 44 formed between the inner casing unit or cartridge 3 with the inlet 9.

Similarly the last pumping stage 28 has its diffuser passage 36 in communication with the discharge outlet 10.

The impellers 33 for each of the pumping stages are keyed to the shaft and sealed in a conventional manner. At the suction inlet end the shaft has a seal housing 46 provided with a sealing sleeve 47 which is disposed in abutting relation with a spacer member 47*a* in turn disposed in abutment with the hub of the first impeller 33 of the first or suction inlet pumping stage 25.

The sealing sleeve 47 is held in assembled position on the shaft 20 by a first locking ring 48 which is threadably connected to the shaft 20.

At the opposite or discharge end of the shaft a balancing drum 49 is fixedly held the hub of the last impeller 33 of the last or discharge pumping stage 28 by an annular locking member 50 and a second locking ring 51 which is threaded into the outboard end of the balancing drum 49 all of which is shown at FIG. 2 of the drawings.

FIGS. 1 and 2 further show that the suction inlet end casing 41, the pumping stages 25, 26, 27 and 28 are so disposed that the suction inlet end casing 41 is in engagement with an abutment shoulder 52 on the seal housing 46 and respectfully the pumping stages 25, 26, 27 and 28 are in abutment with each other and with the suction inlet end casing 41. However while the hubs 31 of the respective impellers 33 are fixed in their position on the shaft, the respective pumping stage casings 30 are relatively movable or slidable relative thereto in order to position and align the respective pump casings 30 with respect to the impellers 33 and other parts of each of the respective pumping stages. However, because the respective pump stage casings 30 are relatively movable it is necessary after the inner unit or cartridge 3 is assembled to provide means to fix the relative position of these elements.

This is accomplished in accordance with the present invention by providing means to stress or compress these parts in such a manner that the shaft 20 acts as a tie-bolt for the inner assembly unit or cartridge 3 as will now be described.

COMPRESSION MEANS FOR CARTRIDGE ASSEMBLY

Accordingly referring further to FIG. 2 at the end of the shaft 20 having the balancing drum 49, an annular balancing ring member 53 is mounted about the balancing drum 49 and disposed at a pre-determined clearance thereon to permit relative motion between these elements in the axial line of the shaft 20.

The annular balancing ring member 53 has an annular shoulder 54 and an annular flange 55 spaced inwardly from the inboard end thereof.

The annular shouler 54 provides a lower abutment point for the inner section 56*a* of a resilient compression ring 56 which lies in a space between the pumping stage casing 30 of the last pumping stage 28 and an end cover member 57 more fully described hereinafter.

Figure 6:
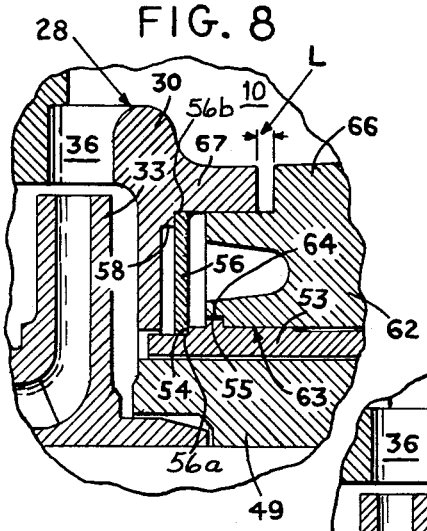
FIG. 6 is a fragmentary view of the resilient element and the elements of the cartridge before the elements are placed under stress.

The outer 56*b* of the resilient compression ring 56 abuts an annular upper shoulder 58 formed on the outboard side of the casing 30 of the last pumping stage 28 all of which is shown in FIG. 6.

Figure 7:
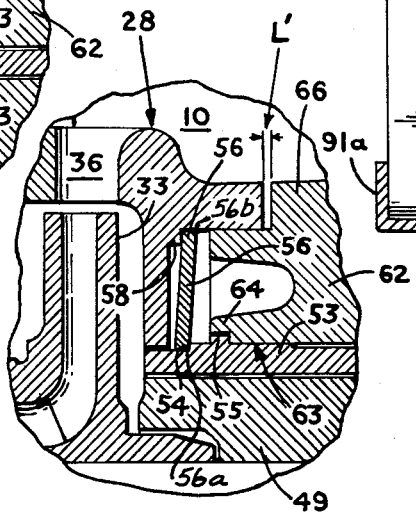
FIG. 7 is a fragmentary view of the resilient element and the elements of the cartridge after the elements are placed under stress.
Figure 12:
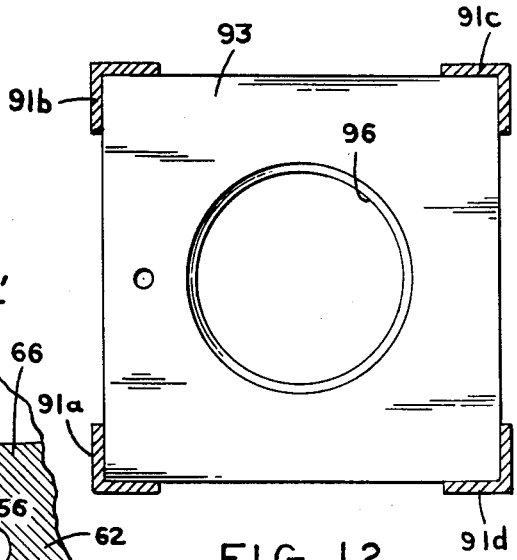
FIG. 12 is a horizontal section taken on line 12—12 of FIG. 11.

When the resilient compression ring 56 is not exerting compressive or stress forces on the elements of the inner unit or cartridge 3 the compression ring 56 will be flat as shown at FIG. 6. When the resilient compression ring 55 has been placed under compression or stress as is hereinafter described it becomes dished as shown at FIGS. 2 and 7 of the drawings. When the means establishing these compressive or stress forces is removed the resilient compression ring 55 will act to release these axial compressive forces and the effect of this will be to hold the elements of the inner unit or cartridge 3 in assembled relationship.

The axial compressive forces by which the resilient compression ring 56 is dished so as to place the same under stress is established by the end cover member 57.

End cover member 57 is generally cylindrical member having a connecting flange 59 with a plurality of circumferentially spaced bores as at 59*a* therein which provide means for connecting the assembled and aligned inner unit or cartridge 3 to corresponding circumferentially spaced and mating threaded members 60 in the end face 61 of the outer casing 2.

The end cover member 57 has a centrally disposed hub section 62 with a central opening 63 which permits the end cover member to be mounted in a press fit relation with the outer face of the annular balancing ring member 53 so that a groove 64 on the inboard side of the central hub 62 will be in continuous abutting engagement with the annular flange 55 on the annular balancing ring member 52.

In order to stress the resilient compression ring 56 it is necessary to exert axial forces on the end cover member 57 and this will be accomplished by means of a fixture or rig at a point separate and away from the site or location of the multi-stage barrel type centrifugal pump 1 which rig simulates the outer casing 2 and more particularly establishes on the rig a spaced distance equivalent to that in the outer casing between an inner assembly shoulder 65 and the annular end face 61 on the outer casing 2 as these are the critical surfaces for proper assembly of the inner unit or cartridge 3 in the outer casing 2 of the pump 1.

To prevent overstressing of the suction inlet end casing 41 and pumping stages 25, 26, 27, and 28, of the inner unit or cartridge 3, the center hub section 62 is provided at the portion remote from the center opening 63 with an annular stop section 66 which will engage an annular axially projecting flange 67 disposed the required radial distance from the axial line of the pump 1 on the outboard side of the pumping stage 30 of the last pumping stage 28.

When the resilient compression ring 56 is fully stressed to provide the necessary compression for holding the aligned and assembled elements of the inner unit or cartridge 3 in assembled position the clearance from L as shown in FIG. 6 to L′ as shown in FIG. 7 which illustrates the change from the unstressed to the stressed position.

Similar to the opposite end of the inner unit or cartridge 3 the end cover member end of the shaft 20 will also be provided with a second seal housing as at 68 outboard of the end cover which is mounted about a sealing sleeve 69 threadably held to the shaft 20 by means of the first locking ring 70.

FIGS. 1, 2 and 3 further show that in order to provide a completely assembled pumping unit and to provide means to pass the stress or compressive forces exerted on the assembled elements of the inner unit or cartridge to the shaft 20 so that it can act as a tie-bolt for the entire inner unit or cartridge 3, semicylindrical coupling elements as at 71 and 72 are disposed at opposite ends of the shaft 20 for holding the respective bearing housings 23 and 24 in aligned position with the respective other elements of the inner unit or cartridge 3. Thus the inner ends of the coupling elements 71 and 72 are respectively connected to as to hold the seal housings 68 and 46 to the end cover member 57 and the suction inlet end casing 41 respectively. At the outer ends the coupling elements are connected respectively to a bearing housing cover element 73 for the bearing 23 and to bearing cover member 74 for bearing housing 24.

When the assembled unit or cartridge 3 is removed from the fixture or rig hereinafter described, the resilient member 56 will exert or release the compressive forces stored therein against the end cover and against the respective suction inlet end cover 41 and the pumping stages 25, 26, 27, and 28, and these forces and the stresses exerted between the elements must be contained and passed to the shaft 20 in accordance with the present invention.

This is accomplished by means of a pair of spaced handling clamps as at 75 and 76 connected respectively at each end of the shaft as is shown in FIGS. 1 and 2 of the drawings in phantomized form.

Thus referring to FIGS. 1, 2, 4 and 5 the spaced handling clamps are shown as substantially semi-cylindrical members having an inwardly extending flange as at 77 and 78 which provides means to hold the handling clamps 75 and 76 to the shaft 20 as by outer locking rings 79 and 80 which coact with the inner locking rings as at 70 and 48 which hold the respective sealing sleeves 69 and 47 to the shaft 20.

The handling clamps 75 and 76 in assembled position are respectively threadably connected to the bearing housing covers as at 73 and 74 by suitable threaded means 81 for handling clamp 75 and 82 for handling clamp 76.

In operation, the parts and elements of the inner unit or cartridge 3 will be assembled and aligned in a suitable fixture or rig hereinafter described so that when all the parts are in order as above described, the suction inlet end casing 41 is disposed in abutting relation with a point on the fixture or rig equivalent to the shoulder 62 on the inner casing 2. The resilient compression ring 52 can then be stressed by threading the end casing member 57 to the point on the fixture or rig equivalent to the end face 61 on the inner casing 2.

Thereafter the handling clamps 75 and 76 are assembled on the shaft 20 by means of the outer locking ring 79 and 80 and the respective handling clamps are then threaded into engagement with the bearing housing cover 73 and 74 all of which is shown in FIGS. 2 and 5 of the drawings.

The threaded members exerting the axial forces on the end cover member 57 can now be removed and the compressive forces stored in the resilient compression ring 55 will then be transmitted axially through the end cover in one direction to handling clamp 75 and through the pumping stages 28, 27, 26, 25 and the suction inlet end casing 41 in the other direction to handling clamp 76.

Since the handling clamps 75 and 76 are fixedly connected to shaft 20, the shaft acts as a centrally disposed tie-bolt to hold all the parts and elements of the inner unit or cartridge 3 in their assembled and aligned position.

Since the unit or cartridge 3 is now held under stress, it can be shifted and moved without fear of changing or affecting the assembly and alignment thereof and therefore it can be brought to the pump and by suitable slings and supporting means mounted in the pump until the bores 59*a* on flange 59 are fitted over the threaded members and the threaded members tightened to complete the assembly of the pump.

When such assembly is completed, the handling clamps 75 and 76 may be removed and the pump is ready for operation.

When it is desired or necessary to remove the inner unit or cartridge to do a routine maintenance check or to correct any damage to the elements or parts thereof, the handling clamps 75 and 76 are reinstalled and then the threaded element 60 removed and by suitable slings and scaffolding the inner unit or cartridge 3 can be removed from the outer casing 2 and placed once again in the fixture or rig where it can be reassembled and readjusted until all the working parts are in proper order at which time the unit or cartridge 3 can then be restressed by again applying the axial forces through the end cover member 57 and utilizing the handling clamps 75 and 76 as has been above described to permit the inner unit or cartridge 3 to be reinstalled in the outer casing 2.

ONE FORM OF SPECIAL FIXTURE FOR ASSEMBLING THE UNIT OR CARTRIDGE

One form of special fixture or rig generally designated 90 for assembling the unit or cartridge 3 is shown at FIGS. 8 to 12 of the drawings as a generally elongated rectangular member which is approximately square in end view.

The fixture or rig 90 includes leg members as at 91*a*, 91*b*, 91*c* and 91*d* which are connected as by welding or any suitable means at spaced relation at the respective corners of transversely disposed and spaced top members 92, intermediate member 93 and bottom member 94.

The respective transverse members 92, 93 and 94 are substantially rigid flat plate like members each having a central opening as at 95, 96 and 97 which are in alignment with each other and will be sized to permit the unit or cartridge 3 to be assembled in the frame or rig 90 and to be removed therefrom after it is assembled, adjusted, aligned and properly stressed so that the handling clamps 75 and 76 will be able to hold the same in the fully preassembled, preadjusted and prealigned condition.

Figure 9:
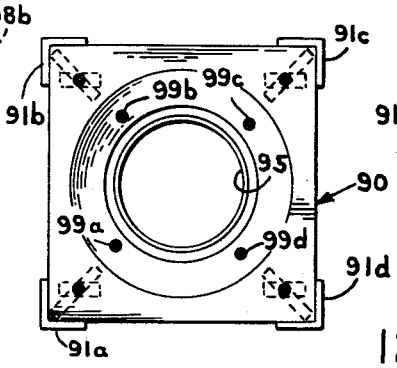
FIG. 9 is a top view of the supporting fixture shown in FIG. 8.
Figure 10:
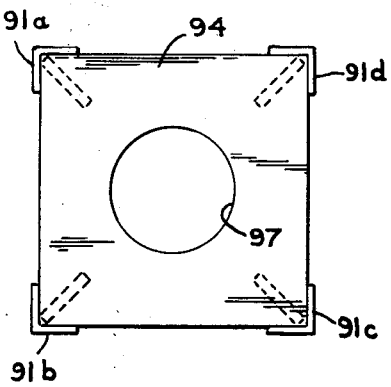
FIG. 10 is a bottom view of the supporting fixture shown in FIG. 8.
Figure 11:
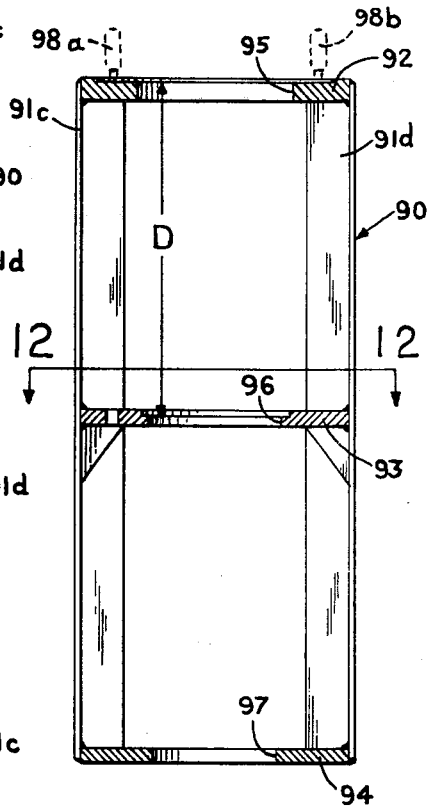
FIG. 11 is a vertical section taken on line 11—11 of FIG. 8.

By reference to FIGS. 9 and 11 of the drawings it is shown that the upper face of the transverse member 92 is disposed a predetermined spaced distance from the upper face of the transverse member 93 a distance generally designated D, this distance being equal to the distance from the end face 61 to the annular stop shoulder 65 of the outer casing 2 against which the inner face of the flange 59 and the shoulder 43 of the suction inlet end casing respectively abut when the preassembled unit or cartridge 3 is installed in the outer casing 2 as is shown in FIG. 2 of the drawings.

Hoist rings or eye bolts as at 98*a* and 98*b* are provided for hoisting and moving the fixture or rig from a vertical to horizontal position particularly when the assembled and aligned unit or cartridge 3 is mounted therein.

The bolt holes as at 99*a*, 99*b*, 99*c* and 99*d* in the top member 92 are disposed to receive threaded elements, now shown, which are extended through the circumferentially spaced bores 59*a* in the end cover to permit axial forces to be exerted on the end cover member when it is desired to stress the resilient compression ring 56 during assembly of the unit or cartridge 3 in the fixture 90.

TRANSPORT MEANS FOR THE ASSEMBLED UNIT OR CARTRIDGE

The fixture or rig shown in FIGS. 8 to 12 is relatively simple and is designed for assembling and handing the unit or cartridge 3 by conventional shop hoisting equipment.

It is thought clear that the inner unit or cartridge is relatively heavy and not easily transported by such locally disposed hoists and rigs if the pump and the shop where the services are to be done are substantial distances from each other.

Accordingly FIGS. 13 to 18 show a transport fixture or rig generally designated 100 which is adaptable for installing or for removing an assembled unit or cartridge 3 from the outer casing 2 of a given multi-stage barrel type centrifugal pump generally designated 1.

The transport fixture or rig 100 includes spaced girders or beams 101 and 102 which are connected to transverse plate like members 103 and 104 by any suitable means such as welding to hold the girders or beams 101 and 102 in predetermined spaced relationship to each other.

Connected on opposite sides of the transport fixture or rig 100 to the outer faces of the girders or beams 100 are spaced caster legs as at 105*a* and 105*b* for the girder or beam 101 and 106*a* and 106*b* for girder or beam 102.

The caster legs are each provided with a connecting bracket as at 107*a*, 107*b*, 107*c* and 107*d* and yoke members 108*a*, 108*b*, 108*c* and 108*d* in which the casters 109*a*, 109*b*, 109*c* and 109*d* are mounted.

The casters will be sized to permit easy rolling of the transport fixture or rig 100 from point to point as may be necessary.

In order to support and move the assembled unit or cartridge 3 in the transport fixture or rig 100, the girders or beams are provided with longitudinally extending tracks as at 110 on girder or beam 101 and 111 on girder or beam 102 which tracks are in spaced relation to each other and so disposed as to movably mount therein a rear support assembly 112 and a front support assembly 113 as is shown in FIGS. 13, 15 and 16 of the drawings.

The rear support assembly 112 is disposed to support the end cover member 57 and includes a main plate like cross member 114 having rollers or wheels on opposite sides thereof as at 115*a* and 115*b* which are spaced a distance equal to the spacing for the longitudinally extending tracks 110 and 111 so that the rear support assembly 112 can move freely to and fro along the tracks when in assembled position.

When in assembled position the plate like member 114 is shaped and sized to fit under the semi-cylindrical coupling element 71 and a plurality of arcuately spaced holes as at 116*a*, 116*b*, 116*c* etc are provided to permit the plate like member to be bolted to the end cover member 57 as is shown in FIGS. 13 and 15 of the drawings.

The front support assembly 113 has a transverse axle as at 117 which also has rollers or wheels as at 118*a* and 118*b* also spaced a distance equal to the spacing for the longitudinally extending tracks 110 and 111 so that the front support assembly 113 can also be moved freely in these tracks as well as back and forth with respect to the unit or cartridge 3 because the front assembly 113 is not connected thereto.

The transverse axle supports spaced brackets 119*a* and 119*b* which are arcuately curved so that they fit in snug engagement with the lower side of the unit or cartridge 3 when the same is mounted in position for insertion or removal of the unit or cartridge 3 from the outer casing 2 of the pump 1.

Figure 17:
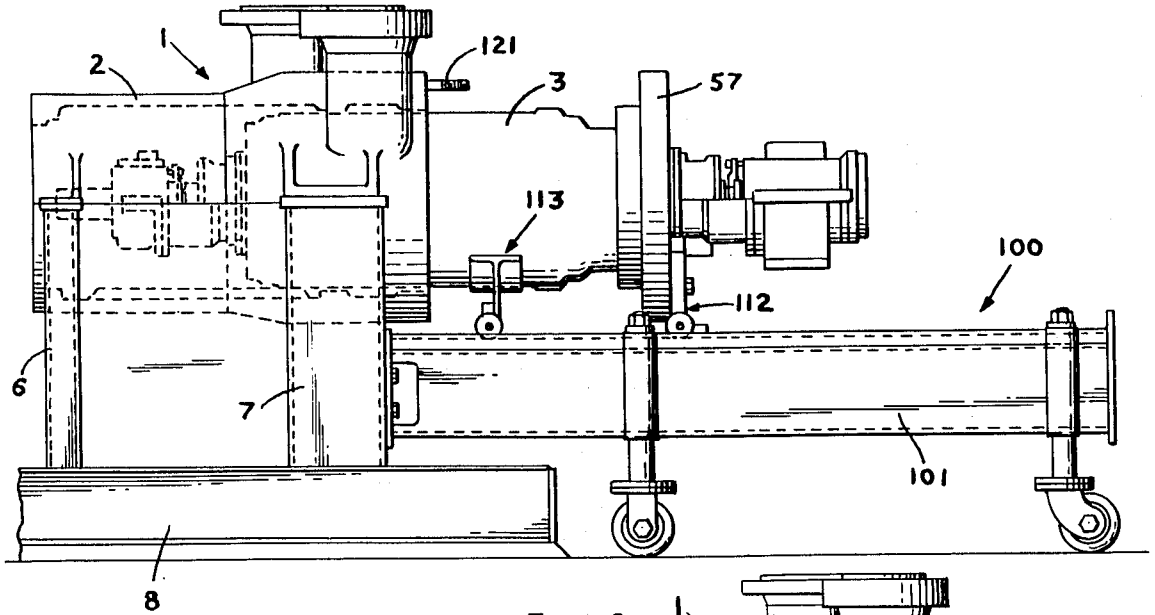
FIG. 17 shows the preassembled unit or cartridge partially installed in the fixed outer casing of the centrifugal pump using the supporting fixture shown in FIG. 11.
Figure 18:
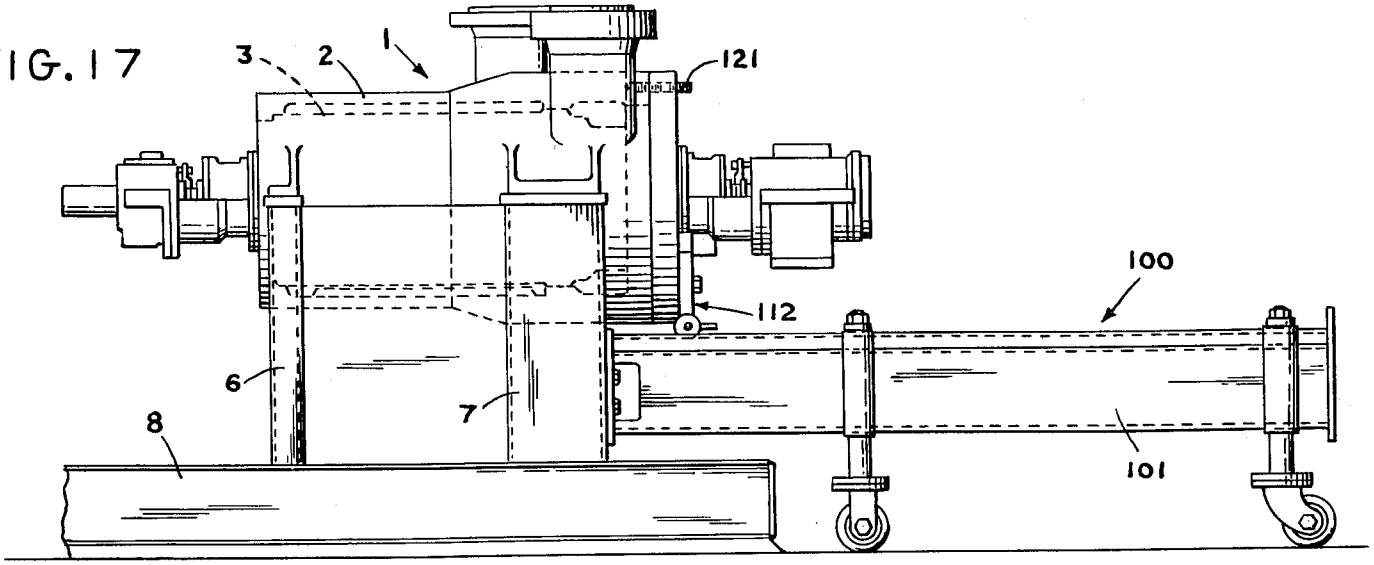
FIG. 18 shows the preassembled unit or cartridge in assembled position in the fixed outer casing of the centrifugal pump using the supporting fixture shown in FIG. 11.

FIGS. 13, 17 and 18 illustrate the manner in which the transport fixture or rig 100 works for installing an assembled unit or cartridge 3 into a given multi-stage barrel type centrifugal pump 1.

In FIG. 13 during the initial stage of installation, the transport fixture or rig 100 is lined up with the pump and bolted as by suitable threaded members 120*a* and 120*b* to the front supports 107 and 107*a* for the pump it being clear to those skilled in the art if the transport fixture or rig 100 is properly sized and aligned that the assembled unit or cartridge 3 will be centered in respect of the outer casing 2 of the pump 1 so that it will fit into position when the unit or cartridge 3 is moved into engagement with the inner walls of the outer casing 2.

This is illustrated at FIG. 17 where the unit or cartridge 3 has been partially moved into position to the point where it engages the slides 74 formed on the inner wall of the outer casing 2 to align and center the unit or cartridge 3 during the installation thereof into the pump 1.

A centering bolt as at 121 is also provided to aid in aligning and centering the unit or cartridge 3 into assembled position.

When the unit or cartridge 3 is in the position as shown in FIG. 17 the front support assembly 113 may be removed so that the unit or cartridge 3 can then be extended or installed further into the pump and finally fully installed as shown in FIG. 18 of the drawings.

After the unit or cartridge 3 is fully installed the box support assembly 112 and the transport fixture or leg 100 are disconnected and removed and then the flange 57 is fully bolted into assembled position to complete the installation of the unit or cartridge 3 in the outer casing 2 of pump 1.

In disassembly or removal the procedure is reversed as will be understood by those skilled in the art and when the unit or cartridge 3 has been removed the transport assembly or fixture 100 is disconnected from the pump 1 and wheeled to the point where the unit or cartridge 3 can be placed in the assembly and alignment fixture 90 which has been above described.

Thus there has been shown and described a preassembled unit or cartridge for a multi-stage barrel type centrifugal pump which permits easy installation or removal of the entire unit or cartridge with the consequent advantages for servicing the same and for rapid changeover when required in connection with the use and operation of such pumps.

It will be understood that the invention is not to be limited to the specific construction or arrangement of parts shown but that they may be widely modified within the invention defined by the claims.

What is claimed:

1. A fixture for preassembling the working parts of a pumping unit to be mounted in engagement with spaced shoulders formed a predetermined spaced distance from each other in the outer casing of a multi-stage barrel type centrifugal pump includes, a. a plurality of longitudinally extending side legs disposed in spaced relation to each other, b. an upper transverse member connected to the upper end of said plurality of longitudinally extending side legs having, a sized access opening therethrough to permit the working parts of the pumping unit to be assembled to be passed into and out of said fixture, c. at least one other transverse member connected to said plurality of longitudinally extending side legs a spaced distance from said upper transverse member having, a sized assembly opening therethrough for holding the working parts of the pumping unit to be assembled, d. a first shoulder means formed on said upper transverse member about the sized access opening formed therethrough disposed for engagement with at least one of the working parts of the pumping unit to be assembled in the fixture.

e. a second shoulder member formed in said other transverse member about the sized assembly opening formed therethrough for abutting engagement with at least one other working part of the pumping unit to be assembled in the fixture, f. said first shouid means and second shoulder means a predetermined spaced distance from each other equivalent to the predetermined spaced distance of the shoulders in said outer casing of the multi-stage barrel type centrifugal pump in which the preassembled working parts of the pumping unit will be mounted, g. threaded bores in said upper transverse member, and h. threaded means in the threaded bores in said upper transverse member to engage said at least one of said working parts to exert axial forces on said working parts of the pumping unit to place the same under compression stresses after the same have been assembled.

2. A fixture for preassembling the working parts of a pumping unit to be mounted in engagement with spaced shoulders formed a predetermined spaced distance from each other in the outer casing of a multi-stage barrel type centrifugal pump include, a. a plurality of elongated longitudinally extending side members disposed in spaced relation to each other, b. a top member connected transverse to and adjacent the top section of each of said plurality of elongated side members having a sized and shaped access opening therethrough to permit the working part of the pumping unit to be assembled to be passed into and out of said fixture, c. an intermediate member disposed and connected transverse to the medial section of said elongated side members and having a sized and shaped assembly opening therein concentric to said access opening for holding the working parts of the pumping unit to be assembled, d. a first shoulder means formed on said top member about the sized access opening formed therethrough and disposed for engagement with at least one of the working parts of the pumping unit to be assembled in the fixture, e. a second shoulder means formed on said intermediate member about the sized assembly opening formed therethrough disposed for abutting engagement with at least one other working part of the pumping unit to be assembled in the fixture, f. said first shoulder means and first second shoulder means disposed a predetermined spaced distance from each other equivalent to the predetermined distance of the spaced shoulders in said outer casing of the multi-stage barrel type centrifugal pump in which the preassembled working parts of the pumping unit will be mounted, g. means on said top member to coact with at least one of said working parts of the pump unit being assembled to exert axial forces thereon after assembly so as to place said working parts of the pumping unit under compression stresses, and h. means on said fixture for transporting the same and for moving the same from horizontal to vertical position and vice-versa.

* * * * *